US005782290A

United States Patent [19]

Cook

[11] Patent Number: 5,782,290

[45] Date of Patent: Jul. 21, 1998

[54] TUBULAR HEAT EXCHANGE SYSTEM

[76] Inventor: David R. Cook, 5355 E. Evans Creek Rd., Rogue River, Oreg. 97537

[21] Appl. No.: 560,451

[22] Filed: Nov. 17, 1995

[51] Int. Cl.[6] ..... F24F 5/00; F28D 1/04; F28D 7/08

[52] U.S. Cl. ..... 165/231; 165/232; 165/55; 165/126; 165/163; 454/305; 454/306; 454/286

[58] Field of Search ..... 165/163, 124, 165/125, 901, 55, 231, 232, 126; 454/305, 306, 286

[56] References Cited

U.S. PATENT DOCUMENTS

| | | | |
|---|---|---|---|
| 1,214,047 | 1/1917 | McGinnis | 165/124 |
| 2,008,255 | 7/1935 | Larkin | 165/124 |
| 2,184,837 | 12/1939 | Hemming | 165/124 |
| 2,903,246 | 9/1959 | Kritzer | 165/124 |
| 2,995,906 | 8/1961 | Brandimarte | 165/124 |
| 3,001,767 | 9/1961 | Straubing . | |
| 3,347,310 | 10/1967 | Lind et al. | 165/124 |
| 3,507,323 | 4/1970 | Ronnholm et al. . | |
| 3,526,274 | 9/1970 | Gardner | 165/163 |
| 3,804,157 | 4/1974 | Wenig | 165/55 |
| 3,937,132 | 2/1976 | Bruhlmeier et al. | 454/305 |
| 3,976,129 | 8/1976 | Silver . | |
| 4,286,419 | 9/1981 | Treffers | 454/286 |
| 4,556,103 | 12/1985 | Kuwa et al. | 165/163 |
| 4,821,797 | 4/1989 | Allgäuer et al. . | |

FOREIGN PATENT DOCUMENTS

| | | | |
|---|---|---|---|
| 27070 | 11/1906 | United Kingdom | 165/124 |
| 29061 | 12/1913 | United Kingdom | 165/163 |

*Primary Examiner*—John K. Ford

*Attorney, Agent, or Firm*—Akin, Gump, Strauss, Hauer & Feld, L.L.P.

[57] ABSTRACT

A tubular heat exchange systems is disclosed. An outer tube section, though which a first medium passes, also contains inner coils, through which a second medium passes. The first medium can be drawn into the outer tube at each end of the tube using pumps or fan motors. The first medium can be released from the outer tube in a way such that the operator of the system can control both the direction and flow rate of the first medium as it is propelled from the system. The first medium is propelled from the system through various openings along the length of the system. The size of these openings can be adjusted by the user. Heat can be transferred from the first medium into the second medium or from the second medium into the first medium.

19 Claims, 8 Drawing Sheets

TUBULAR HEAT EXCHANGE SYSTEM

SPECIFICATION

BACKGROUND OF THE INVENTION

1. Field of the Invention

This invention relates to heat exchange systems, and, more particularly, to tubular heat exchange systems that can either (1) absorb heat from a first medium passing through the system into a second medium passing through a series of coils positioned inside the system, or (2) transfer heat from the second medium passing though the series of coils positioned inside the system into the first medium as it passes through the system. The operator of the heat exchange system can control both the direction of the flow of the first medium as it is propelled from the heat exchange system and the flow rate of the first medium through the system.

2. Description of the Prior Art

The heat exchangers described in the prior art generally draw a medium, such as a fluid or gas, into one side or end of the heat exchanger, propel the medium though the heat exchanger and then propel the medium out of the other end or side of the heat exchanger. U.S. Pat. No. 3,001,767, for a "Tubular Structure" issued to C. R. Straubing, discloses a tubular structure that can be used for such a system, where a first tube with a relatively small diameter is positioned within a tube of greater diameter. U.S. Pat. No. 3,507,323, for a "Tube Heat Exchanger" issued to A. A. Ronnholm, et. al., also discloses a tubular heat exchange system having an inlet and an outlet for the medium to be heated. U.S. Pat. No. 3,976,129, for a "Spiral Concentric-Tube Heat Exchanger" issued to Silver, discloses another heat exchange system where the heat transfer tubes are helically coiled.

Heat exchange systems in the prior art also generally use fins to increase the potential heat exchanging surface area, thereby increasing the heat transfer capability of the heat exchange system. For example, U.S. Pat. No. 4,821,797, for a "Fluid Cooler" issued to Allgauer et. al., discloses a heat exchange system including radially extending heat exchange fins.

Heat exchangers described in the prior art are often comprised of many different metals which contact each other in a condensate saturated environment. This factor can contribute to the corrosion and failure of such heat exchange systems.

Prior art heat exchanges have a number of fans or pumps determined by factory construction. These fans or pumps are generally not adjustable by the operator of the system.

Prior art heat exchangers do not provide the user with the ability to adjust the direction of the medium as it is propelled from the system or the flow rate of the medium as it travels through the system—the heated or cooled medium is propelled through a pre-determined path at a pre-determined flow rate that cannot be easily adjusted by the operator of the heat exchange system. In addition, prior art heat exchangers operating in lower temperatures in high humidity environments will often collect frost and must be defrosted. This defrosting process is generally activated by a timer or by temperature sensing.

SUMMARY OF THE INVENTION

One objective of this heat exchanger is to provide the user with the ability to control the direction and rate of the medium as it is propelled from the system. Another objective is to maximize the efficiency of the heat transferred between the two media at different temperatures. Another objective is to provide a heat exchange system that is compact. Another objective is to provide a heat exchange system which is simple to construct, easy to manufacture and maintain, and is flexible so that the user can modify and customize the system for different applications.

The heat exchanger of this invention draws a first medium into the tubular heat exchange system from both ends of the heat exchange system. A second medium flows through a series of heat transfer coils positioned within the tubular heat exchange system such that the first medium is in contact with the outer walls of the coils and the second medium is in contact with the inner walls of the coils. These heat transfer coils can be positioned within the system in various configurations, including braided or straight configurations. Accordingly, heat can be transferred from the first medium into the second medium or from the second medium into the first medium through the walls of the heat transfer coils.

The heated or cooled first medium can then be released throughout the length of the tubular system in a controlled manner. In an alternative embodiment, the tubular heat exchange system draws the first medium into the system from multiple predetermined positioned locations along the length of the heat exchange system as well as from each end of the tubular heat exchange system. The invention is constructed so that fans, blowers, or pumps that draw the first medium into the system can be added at any location along the length of the tube.

The heat exchange system propels the first medium out of adjustable openings along the length of the heat exchange tube. The size and locations of these openings can be easily adjusted by the user of the system. The tubular heat exchange system can be adjusted such that the first medium may be released in many different directions at the same time, thereby providing heated or cooled medium in directions determined by the user of the tubular heat exchange system. The user or operator of the system can aim the medium flow at target areas that can vary at different times.

The present invention can control the flow rate of the first medium through the system to increase heat transfer capacity of the system. By using a controlled flow rate rather than fins to increase the heat exchanging capacity, the invention is less expensive to construct and makes the invention more versatile to different environments. Fins often become plugged with foreign matter, require significant maintenance, and can be difficult to repair. The heat exchange system disclosed eliminates these problems.

The prior art heat exchange systems tend to be bulky and take up excess useful space. The present invention is more compact and, as a result of its adjustable flow rate and directional first medium flow control, can be positioned in more useful spaces. The present invention can also use a light source and light receiver to detect frost and activate a defrosting mechanism.

DETAILED DESCRIPTION OF THE INVENTION

Figure 1:
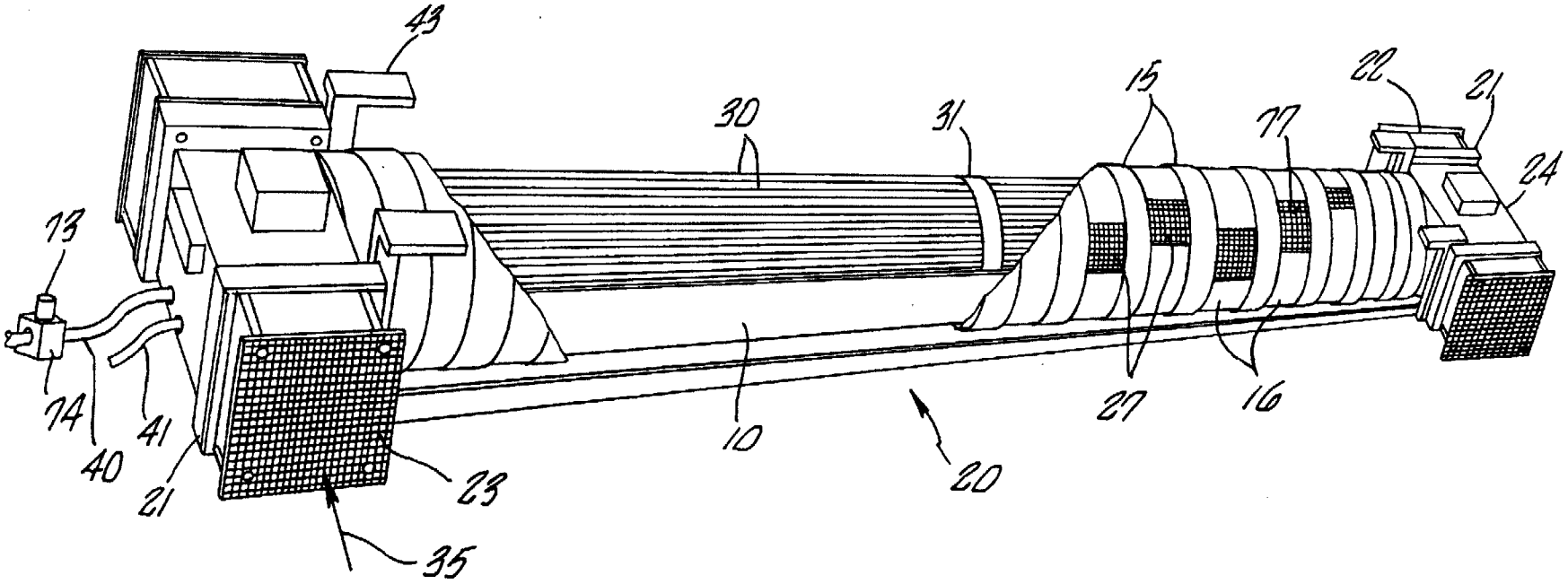
FIG. 1 is a perspective cut-away view of the tubular heat exchange system in accordance with one preferred embodiment of the invention.

A typical embodiment of the invention is illustrated in FIG. 1. The tubular heat exchange system 20 includes an inner tubular casing 10 which houses various components of the heat exchange system 20. This inner tubular casing 10 gives the tubular heat exchange system 20 its rigid strength and is the base structure for heat transfer coils 30 positioned within the tubular heat exchange system 20.

Figure 3:
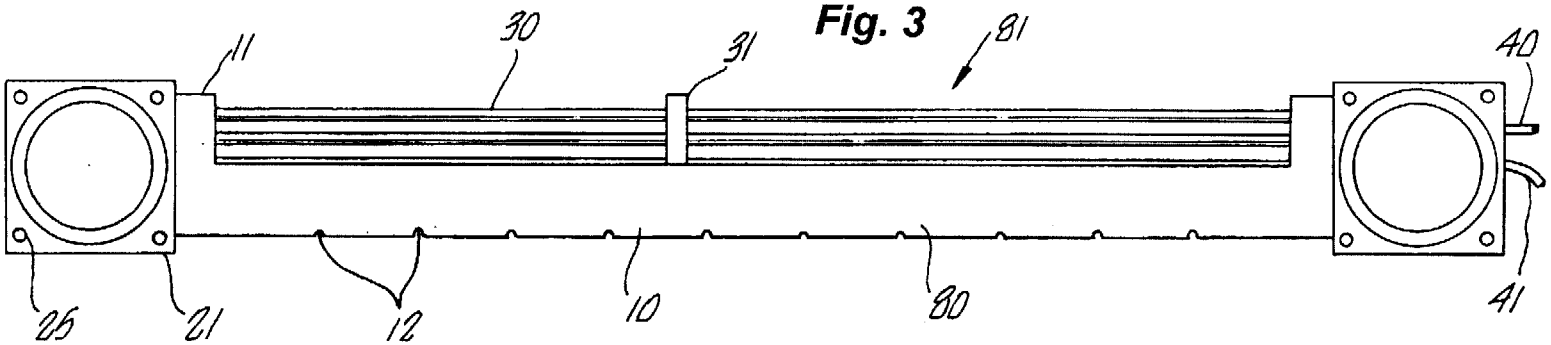
FIG. 3 is a side view of the heat transfer coils positioned within the inner tubular casing of the heat exchange system.

As illustrated in FIG. 3, the inner tubular casing 10 has a solid tube portion 80 and a cut away tube portion 81. Each end of the inner tubular casing 10 is not cut-away, leaving full round end notches 11 at both ends. As illustrated in FIG. 1, these end notches 11 can be secured to the pumps 22 using a flange 21. Pump Ts 24 or tubular turns, such as 90 degree turns, can be attached to the notches 11 at each end of the tubular heat exchange system 20.

As illustrated in FIG. 1., a first medium 35 is drawn into the tubular heat exchange system 20 and travels through the inner tubular casing 10. The first medium 35 is drawn into the heat exchange system though the pumps 22 positioned at each end of the system. These pumps 22 can be blowers, fans, or pumps, depending on the nature of the first medium 35. The speed and amount of the flow of the first medium 35 through the heat exchange system 20 can be regulated by varying the speed of the pumps 22. In addition, the speed and amount of flow of the first medium 35 through the tubular heat exchange system 20 can also be regulated by adjusting the slide rings 16, as described below, or by adding additional pumps 22 to the tubular heat exchange system 20.

A second medium 36 flows through the heat transfer coils 30 positioned within the tubular heat exchange system 20. The plurality of individual coils comprising the heat transfer coils 30 can be made of material with a high thermal conductivity such as copper.

The second medium enters the heat transfer coils 30 at the coil intake 40. The rate that the second medium 36 enters the heat transfer coils 30 can be controlled by various means known in the art, such as a standard valve 74. If the tubular heat exchange system 20 is to release a cooled first medium 35, the second medium 36 enters the system at a cooler temperature than that of the first medium 35 as the first medium 35 is drawn into the system by the pumps 22. Heat is then transferred from the first medium 35, which flows along the outer walls of the heat transfer coils 30, into the second medium 36 which flows inside the heat transfer coils 30. The cooled first medium 35 is then released from the tubular heat exchange system 20 through various openings along the length of the tubular heat exchange system 20. The heated second medium 36 exits the system at the coil release 41 at the end of the heat transfer coils 30.

Alternatively, if the system is to release a heated first medium 35, the second medium 36 enters the heat transfer coils 30 at the coil intake 40 at a greater temperature than that of the first medium 35 as it is drawn into the system by the pumps 22. Heat is then transferred into the first medium 35 which flows along the outer walls of the heat transfer coils 30 from the second medium as it flows through the heat transfer coils 30. The heated first medium 35 is released from the tubular heat exchange system 20 though various openings along the length of the heat exchange system 20, while the cooled second medium 36 exits the system at the coil release 41.

Figure 4:
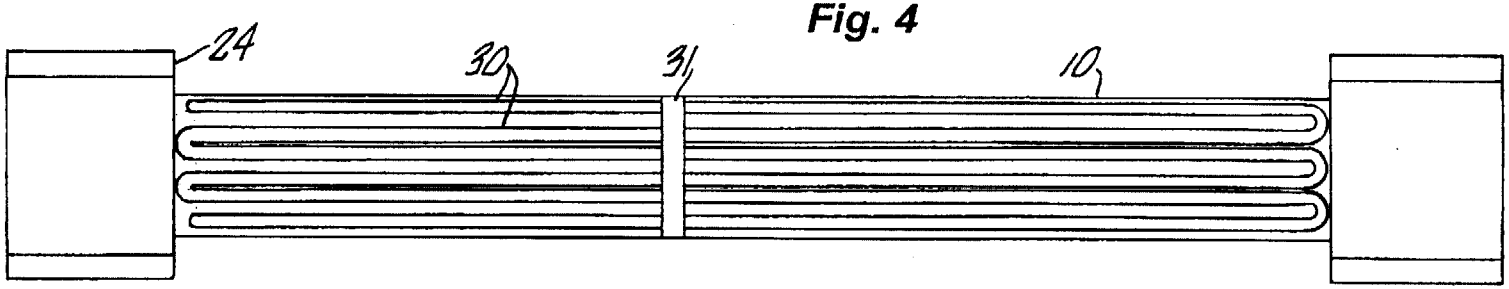
FIG. 4 is a top view of the heat transfer coils positioned within the inner tubular casing of the heat exchange system.

FIGS. 3 and 4 illustrate cut-away views of the tubular heat exchange system 20 of the present invention. Heat transfer coils 30 are positioned within the inner tubular casing 10. In this embodiment, the heat transfer coils 30 are straight. The straight heat transfer coils 30 are used to reduce frost problems associated with operating a heat exchange system at low temperatures. The heat transfer coils 30 can be positioned relatively high in the inner tubular casing 10. The size of the heat transfer coils 30 can vary, depending on the specific application and the amount of heat needed to be transferred.

Figure 5:
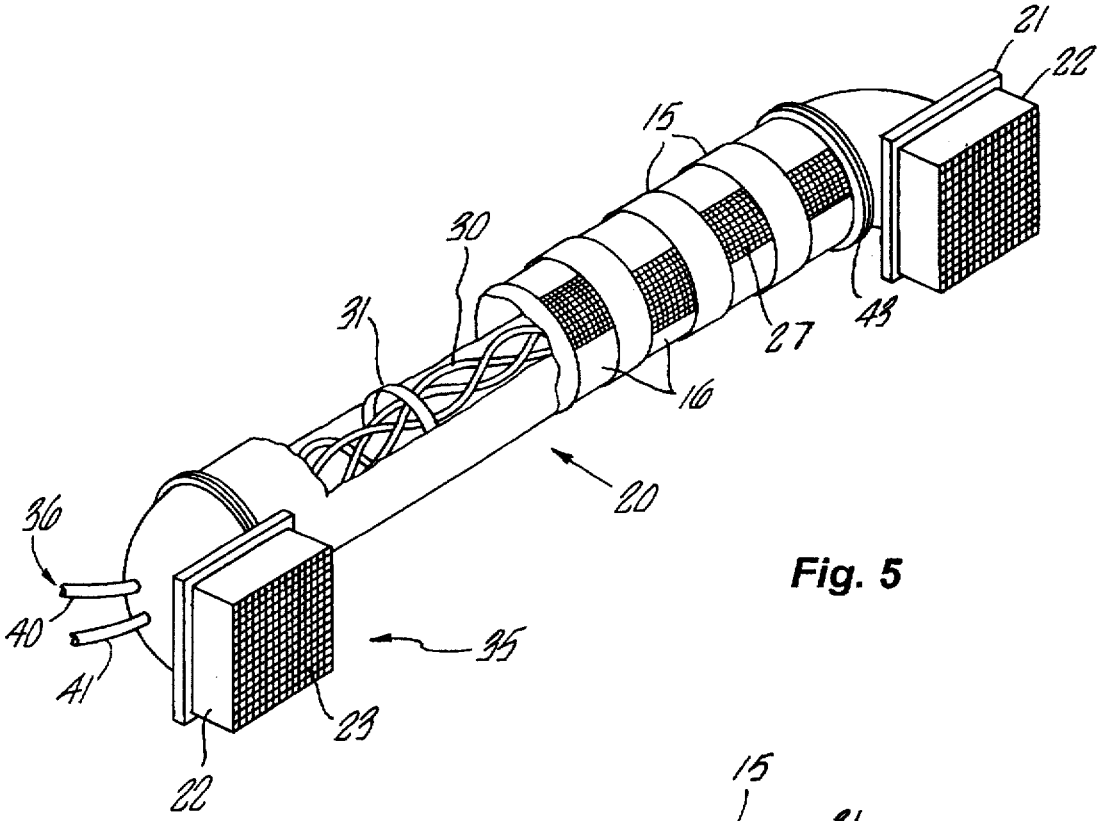
FIG. 5 is a perspective cut away view of the tubular heat exchange system where the heat transfer coils are braided.
Figure 6:
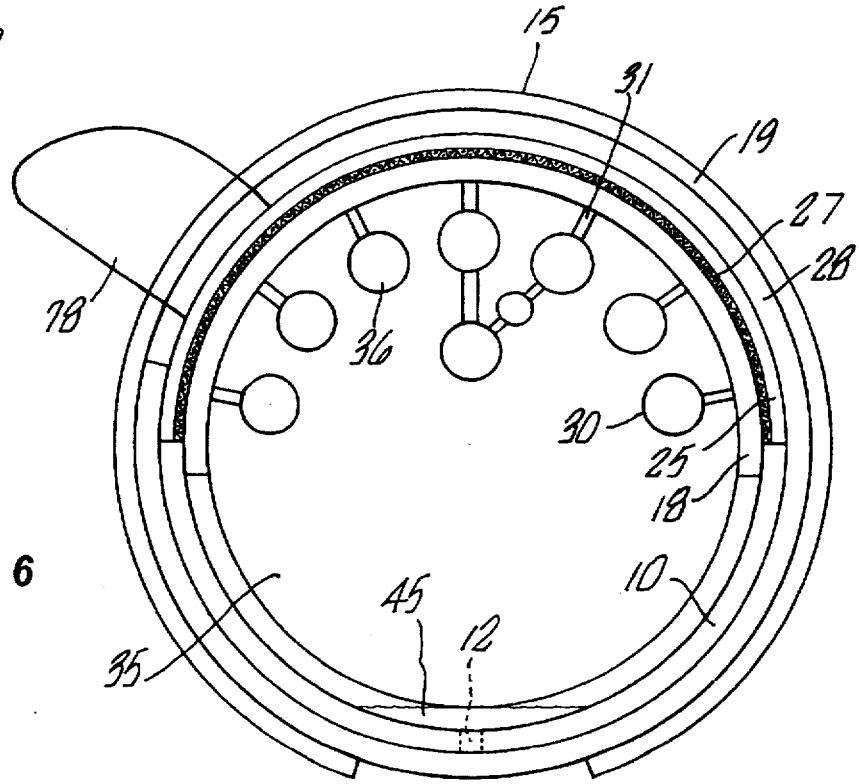
FIG. 6 is a close-up cut away view of the ring configurations around the preferred embodiment of the heat exchange system.

FIG. 5 illustrates a cut-away view of an alternative structure for the heat transfer coils 30 of the tubular heat exchange system 20 of the present invention. In this embodiment, twisted or braided heat transfer coils 30 are positioned within the inner tubular casing 10. These braided heat transfer coils 30 may comprise most of the volume inside the inner tubular casing 10. In low temperatures, the defrosting process must be increased to insure that all of the condensate 45 leaves the inner tubular casing 10 through drain holes 12 which can be located at the bottom of the inner tubular casing 10, as illustrated in FIG. 3. In these other embodiments, size of the heat transfer coils 30 can also very depending on the application of the tubular heat exchange system 20.

The heat transfer coils 30 can be secured to the heat exchange system 20 through various means known in the art. In the preferred embodiments, as illustrated in FIGS. 3 and 4, a coil brace 31 or a series of coil braces secure the heat transfer coils 30 in place. These coil braces 31 also prevent the heat transfer coils 30 from vibrating together. The coil braces 31 can also be used to secure the heat transfer coils 30 at each end of the tubular heat exchange system 20. These coil braces 31 can be positioned along the length of the tubular heat exchange system 20 as needed, depending on length and diameter of heat transfer coils 30.

Figure 12:
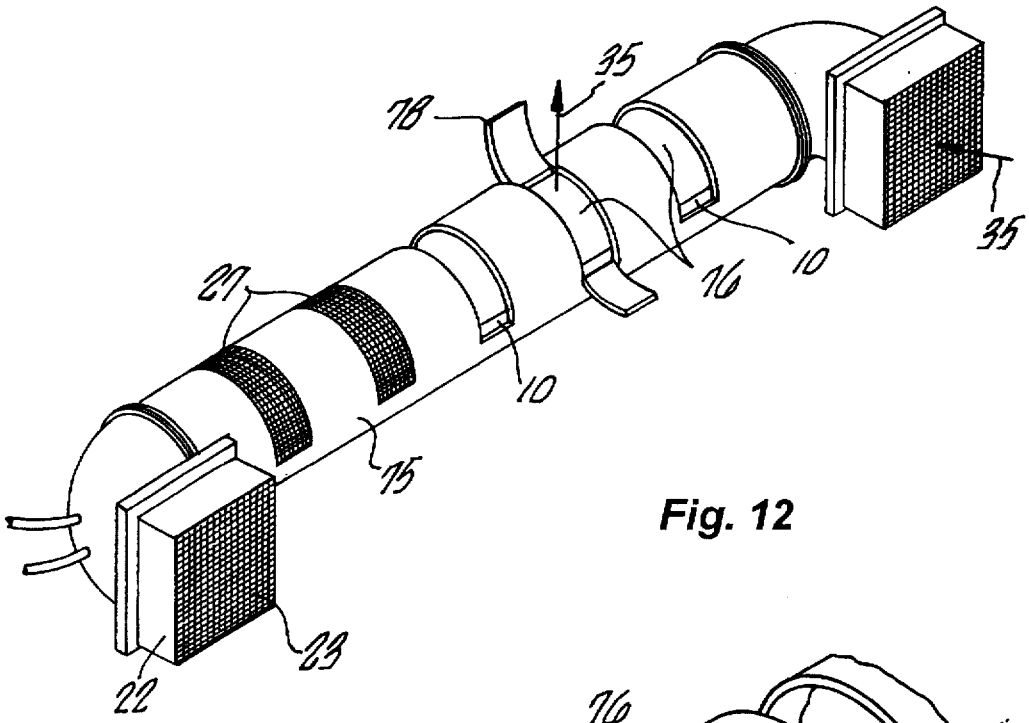
FIG. 12 is a perspective view of the tubular heat exchange system in accordance with a simple design.

FIG. 12 illustrates a simple design for releasing the heated or cooled first medium 35, in a controlled manner, from the heat exchange system 20. In this simple embodiment, an outer tube 75 is positioned around the inner tubular casing 10. A series of slots 76 are cut away from the outer tubing 75.

The heated or cooled first medium 35 can be released from the heat exchange system 20 through these slots 76.

The outer tube 75 can be rotated around the inner tubular casing 10 to adjust the size and locations of the openings 77 through which the first medium 35 is propelled from the system. A deflector 78 can be secured near the openings 77 to direct or control the flow of the first medium 35 as it is propelled through the openings 77. In addition, outer casing screens 27 can be secured over the openings 77 to prevent foreign material from falling into inner tubular casing 10.

The preferred embodiment of the present invention is illustrated in FIGS. 1, 2, 5 and 6. In this embodiment, a series of rings, positioned around the inner tubular casing 10, control the release of the first medium 35 from the tubular heat exchange system 20. The series of rings provide the user with more flexibility in releasing the first medium 35 from the tubular heat exchange system 20.

Figure 8:
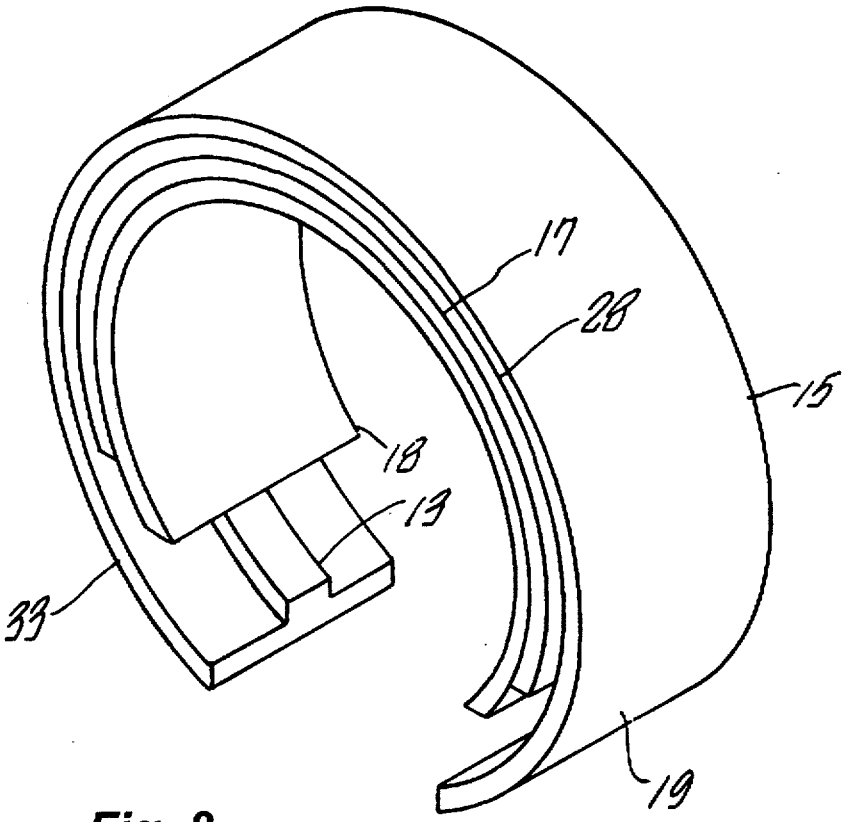
FIG. 8 is a perspective view of the grooved outer keeper ring of the preferred embodiment.

As illustrated in FIG. 1., the inner tubular casing 10 supports a series of grooved outer keeper rings 15 positioned around the inner tubular casing 10, at various intervals, along the length of the tubular heat exchange system 20. These outer keeper rings 15 surround and help support the inner tubular casing 10. Slide rings 16 are also positioned around the inner tubular casing 10 at various intervals along the length of the tubular heat exchange system 20, located between and secured by the outer keeper rings 15. These slide rings 16 are secured in place around the inner tubular casing 10 by the grooves in the outer keeper rings 15. As illustrated in FIG. 8, the outer keeper rings 15 have grooves on each side 33 into which the slide rings 16 are secured and can be rotated around the inner tubular casing 10. The grooved outer keeper ring 15 has an outer ring portion 19, an inner ring portion 18, a groove ring slide 13 positioned on the inner wall of the outer ring portion 19, and a center ring portion 17, located between the inner ring portion 18 and the outer ring portion 19. These various portions of the grooved outer keeper ring 15 can be made of separate components that are secured together or they can be manufactured as a single component.

Figure 7:
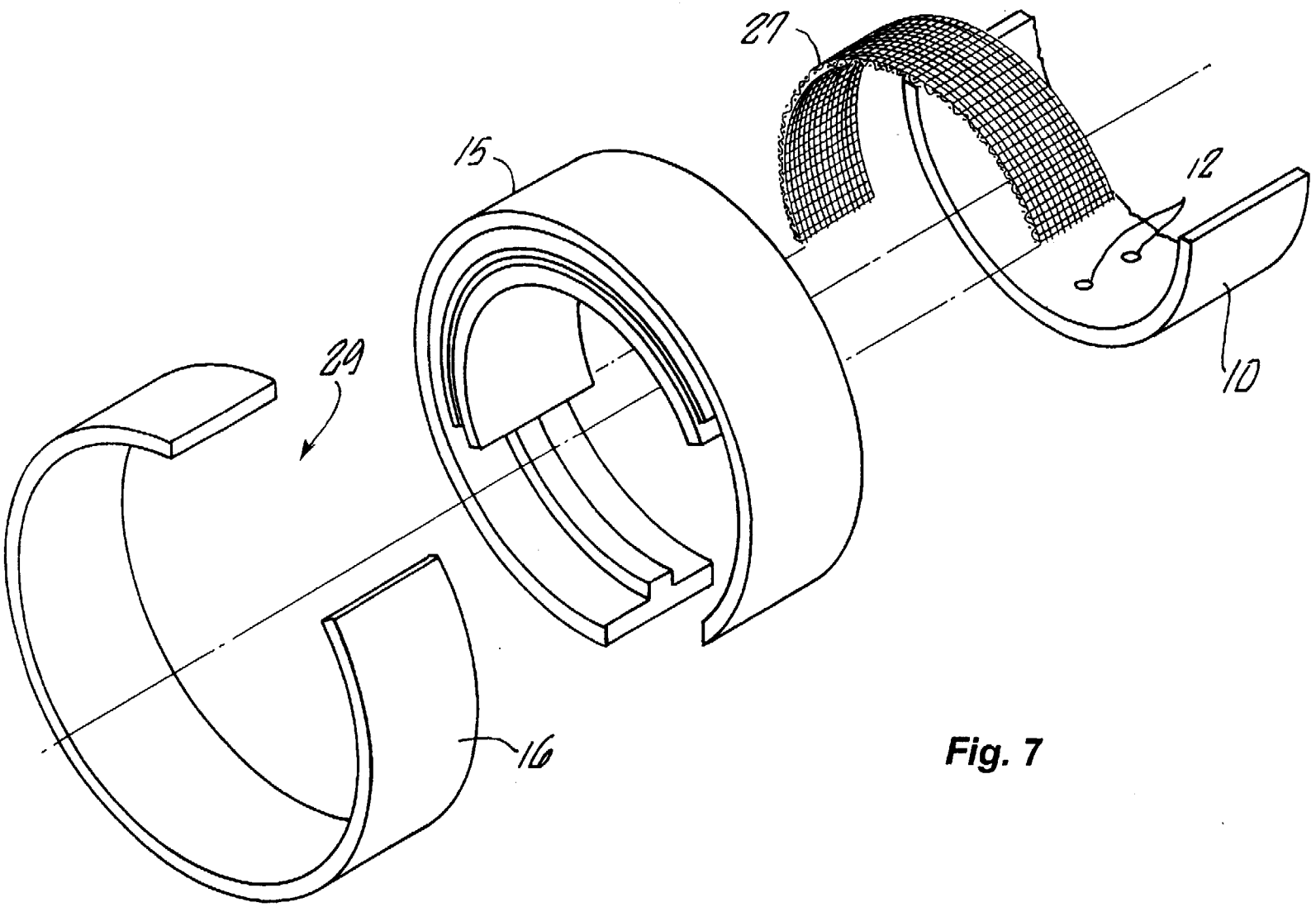
FIG. 7 is a perspective exploded view of the ring configuration system of the preferred embodiment of the present invention.

The grooved outer keeper rings 15 may completely encircle the tubular heat exchange system 20. The slide rings 16, however, do not completely encircle the system, leaving a slide ring gap 29, as illustrated in FIG. 7. This slide ring gap 29 is the opening 77 though which the first medium 35 can be released from the tubular heat exchange system 20. As the slide ring 16 is rotated around the system, the slide ring gap 29 also rotates around the system, thereby adjusting both the direction of the propelled first medium 35 and the size of the opening 77. By moving the slide ring 16, the user can adjust the size and location of the opening 77 that the first medium 35 is propelled through, thereby providing the user with the ability to control the flow rate and the flow direction of the heated or cooled first medium 35. As each slide ring 16 can be adjusted independently of any other slide ring 16, the user of the system has flexibility in the direction and amount of the release of the first medium 35 along the entire length of the tubular heat exchange system 20. The rotation of the each slide ring 16 can be controlled manually or, alternatively, can be controlled though a mechanical system such as an actuator system.

Casing screens 27 can also be positioned over these openings 77. In the preferred embodiment, the outer casing screens 27 are supported and positioned between the grooved outer keeper rings 15, and secured in place by the grooved outer keeper rings 15, between the inner ring portion 18 and the center ring portion 17. The outer casing screens 27 are also positioned along the tubular heat exchange system 20 at various intervals, positioned over each opening 77. The outer casing screens 27 prevent foreign material from falling into inner tubular casing 10. When the heat exchange system 20 is operating, the first medium 35 is released from the heat exchange system though the outer casing screens 27 covering the openings 77.

The slide rings 16 can be secured between the outer keeper rings 15 between the center ring portion 18 and the outer ring portion 17 of the grooved outer keeper ring, as illustrated in FIG. 8. The center ring portion 17 can be positioned on the inside of the outer keeper rings 15 such that the slide rings 16 are secured between the center ring portion 17 and the outer rings portion 19 of the grooved outer keeper rings 15. These slide rings 16 can then rotate around the heat exchange system 20 between the center ring portions 17 and the outer ring portions 19 of the grooved outer keeper rings 15.

In an alternative embodiment, the slide ring 16 can be constructed in two pieces. This provides the user with a greater ability to control the flow of the first medium 35 and the direction of the flow of the first medium 35 as it is released from the heat exchange system 20.

Figure 11:
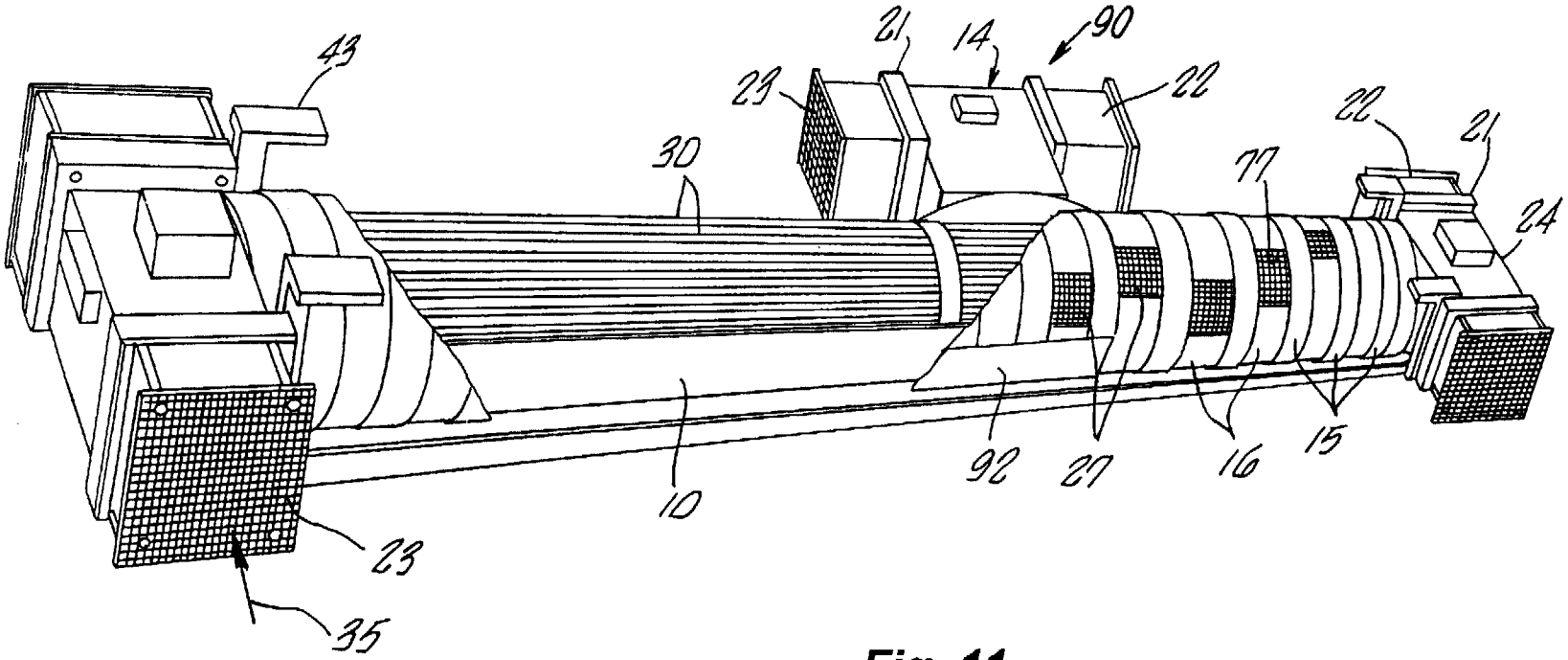
FIG. 11 is a cut-away perspective view of the tubular heat exchange system in accordance with an alternative embodiment of the invention containing an additional pump system positioned at the center of the tubular heat exchange system.

As illustrated in FIG. 1, pumps 22, blowers, or fans are positioned at each end of the tubular heat exchange system 20. In addition to being placed at each end, these pumps 22 can also be positioned, at any interval, along the length of the tubular heat exchange system 20 as illustrated in FIG. 11. These pumps 22 draw the first medium 35 through the tubular heat exchanger 20 through the use of suction. The size of these pumps 22 can very depending on the application.

Pump screens 23 can be positioned over each of the pumps 22. These pump screens 23 prevent foreign matter such as dirt or debris from entering the pumps 22 and the inner tubular casing 10. The pump screens 23 are also perform a safety function, preventing anyone from accidentally contacting the propellers of the pumps 22. The pump screens 23 can be attached to the pumps 22 using an attachment mechanism 25, such as a series of bolts, as illustrated in FIG. 3.

The pumps 22 can be secured to the tubular heat exchange system 20 using attachments known in the art. As illustrated in FIG. 1, the pumps 22 can be secured by flanges 21 which connect the pumps 22 to the tubular heat exchange system 20. The flanges 21 can be positioned at each end of the system, where the pumps 22 are to be secured to the inner tubular casing 10, and any other locations where the pumps 22 are to be secured to the system.

Pump Ts 24 or in-line snap-Ts 92 can be used to secure the pumps 22 to the tubular heat exchange system 20 depending on the location of the pump. Alternatively, tubular turns can be positioned at the ends of the heat exchange system 20 to secure the pumps 22 to the system. These pump Ts and in-line snap Ts, or 24 or tubular turns allow the pumps 22 to be located in many different positions at the ends of the system or along the length of the system.

In one embodiment of the present invention, pump Ts 24 can be positioned at each end of the heat exchange system 20 as illustrated in FIG. 1. As illustrated in FIG. 11, in-line snap-Ts 92 can be secured to the inner tubular casing 10 using modified outer keepers rings 15 and slide rings 16. The in-line snap-T 92 can be added along the tubular heat exchange system 20 in the factory, before the user purchases the system, or in the by the operator before the system is to be used. These in-line snap Ts 92 can be added anywhere along the tubular heat exchange system 20 where additional pumps 22 are desired. The in-line snap-T 92 fits around the inner tubular casing 10. Outer keeper rings 15 and slide rings 16 can be used to secure the snap-T 92 in place. A pump 22, flange 21, or turn, such as a 90 degree turn, can be secured to the in-line snap-T 92. In addition, system may be sold such that the operator of the system has the ability to adjust the ends of the system to meet specific requirements.

Figure 2:
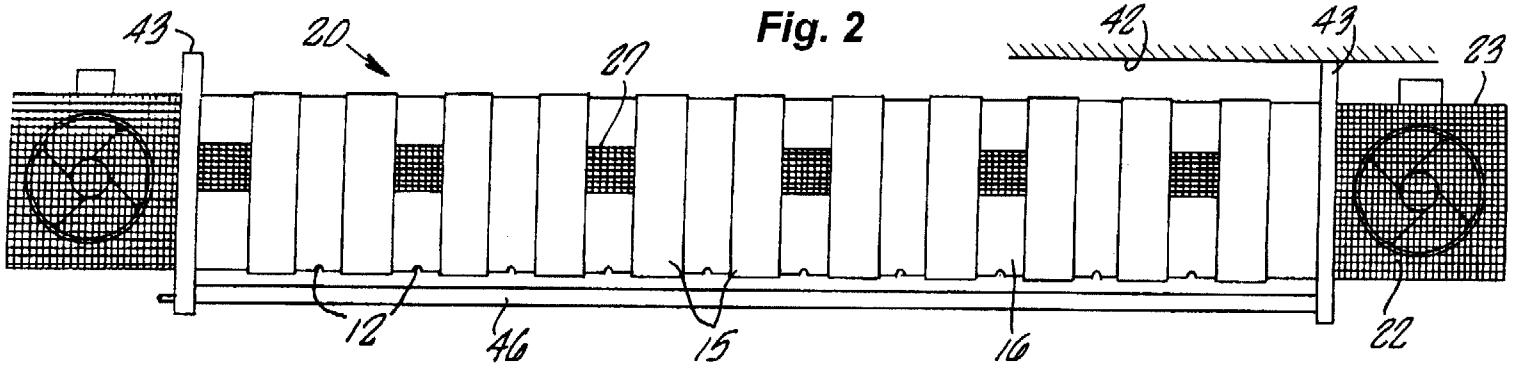
FIG. 2 is a side view of the tubular heat exchange system.

As illustrated in FIG. 2, mounting hardware 43 can be used to secure the tubular heat exchange system 20 to a mounting surface 42. The mounting hardware 43 can be secured around the inner tubular casing 10 and attached to the mounting surface 42. The mounting hardware 43 can very, depending on the heat exchanger application. Examples of mounting hardware 43 include bolts, brackets or other mounting devices known in the art.

As illustrated in FIG. 2, holes 12 can be positioned at the bottom of inner tubular casing 10 to allow condensate 45, formed within the heat exchange system 20, to be released from the heat exchange system 20. The condensate 45 exits heat exchange system 20 through the holes 12.

Figure 10:
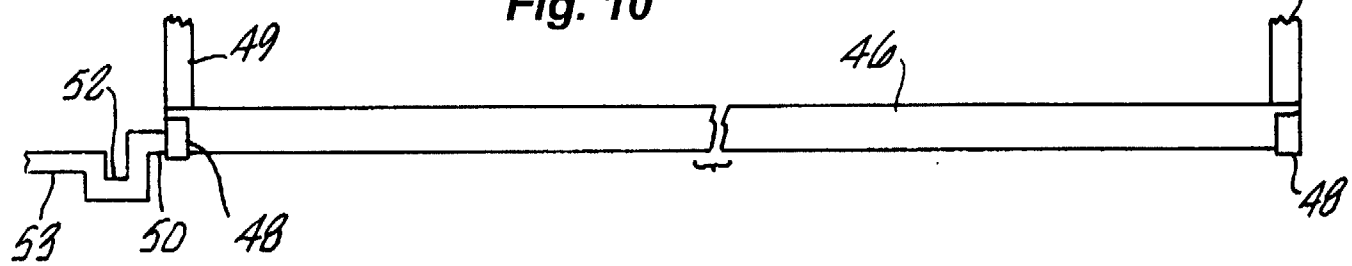
FIG. 10 is a side view of the drainage system for the tubular heat exchange system.

A drainage system can be included such that the condensate 45 enters a drain pan 46 positioned below the holes 12. FIG. 10 illustrates a drainage system for the tubular heat exchange system 20. A drain pan 46 may be used to collect condensate 45. The drain pan 46 can be a tube, cut in half, with plugs 48 positioned on both ends of the drain pan 46 to prevent the condensate 45 from being released at either end of the drain pan 46. The drain pan 46 can extend along the bottom of the inner tubular casing 10 to collect the condensate 45 released from the holes 12 along the length of the tubular casing 10.

The drain pan 46 can be connected to the tubular heat exchanger 20 by securing the drain pan 46 to the heat exchanger mounting hardware 43. The drain pan 46 can be secure by any attachment mechanism 49 known in the art, connecting the drain pan 46 to the heat exchanger mounting hardware 43. The drain pan 46 can be positioned at an angle such that the condensate 45 will drain to one end of the drain pan 46. In this configuration, one of the drain plugs 48 is positioned at low end of the drain pan 46. This end is the drain exit 50. A pee trap 52 can be connected to the drain plug 48 at the low end of the drain pan 46. A drain line 53 can be connected to other end of pee trap 52. The condensate 45 can exit the drain pan 46 through the pee trap 52 and into the drain line 53 and thereby be drained to any predetermined location.

Figure 9:
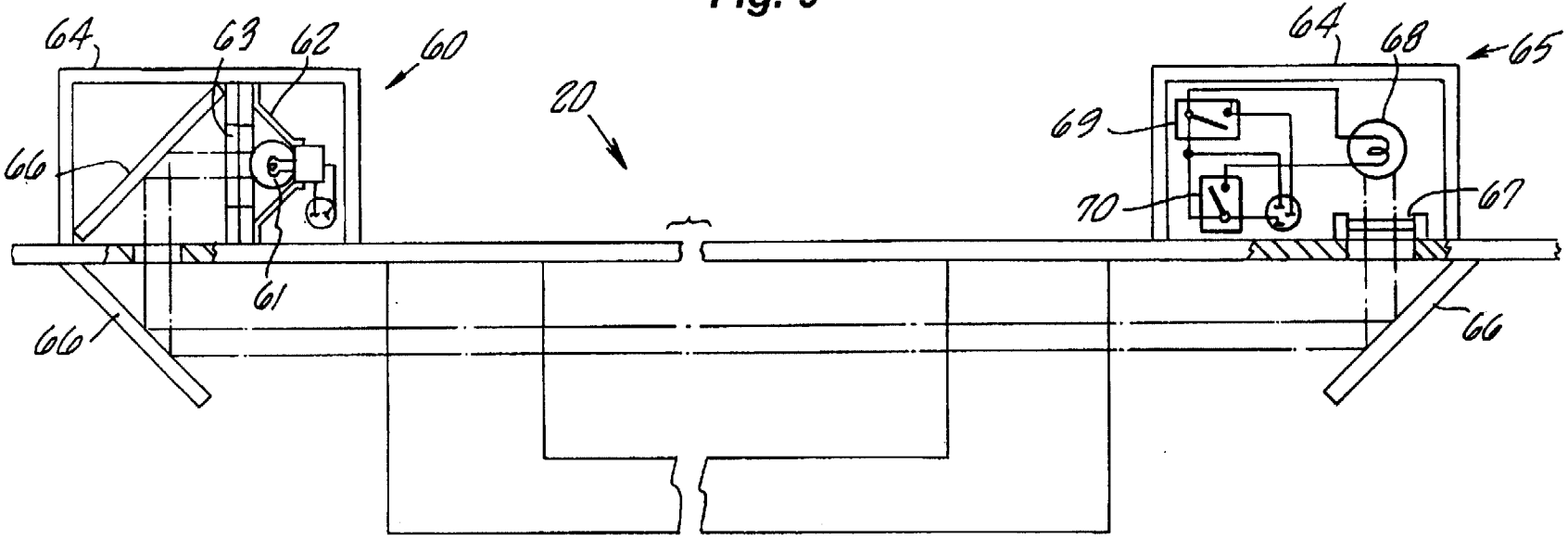
FIG. 9 is a schematic of the automatic defrost system of the present invention.

A defrost system can be also included as part of the invention to limit the buildup of frost in the tubular heat exchange system 20. In one embodiment of a defrost system, a focused defrost control light source 60 can be positioned at one end of the heat exchange system 20. As illustrated in FIG. 9, the light source 60 can consists of a light bulb 61, a reflector 62, a focusing lens 63 and angled mirrors 66. The light source 60 emits light which is reflected by the reflector 62 and directed though the focusing lens 63. The light bulb 61, reflector 62, focusing lens 63, and angled mirrors 66 can be contained in a casing 64.

A light receiver 65 can be positioned at the other end of the tubular heat exchange system 20. The light receiver 65 can be comprised of an angled mirror 66, a light filter 67, a photo-electric cell 68, a relay 69, and a timer 70. When there is little or no frost build-up in the tubular heat exchange system 20, the light leaves the light source 60 through the focusing lens 63 and is reflected off the angled mirrors 66 into the tubular heat exchange system 20 unobstructed, reaching the light receiver 65. The light is reflected off of the angled mirror 66 at the receiving end, through the light filter 67 and into the photo-electric cell 68 which can detect the light. The photo-electric cell 68 controls a relay system 69. This relay system 69 controls a solenoid operated valve 73 positioned at the valve 74 of the coil intake 40 of the heat exchange system 20. As long as the photo-electric cell 68 detects light, the relay 69 remains energized, which in turn, energizes the solenoid vale 73. The solenoid valve 73 maintains the valve 74 in an open position so that the second medium 36 can flow through the valve 74, into the heat transfer coils 30, and through the tubular heat exchange system 20.

If there is frost build-up in the heat exchange system 20, the frost obstructs the light leaving the light source 60 and the light may not reach the light receiver 65 and, in turn, the photo-electric cell 68. In this situation, the photo-electric cell 68 de-energizes the relay 69 which, in turn, de-energizes the solenoid valve 73. This causes the valve 74 to close, thus preventing the flow of the second medium 36 from passing through the valve 74 into the heat transfer coils 30 and into the tubular heat exchange system 20. Under these circumstances, the first medium 35, however, continues to flow through the tubular heat exchange system 20. Heat is transferred from the first medium 36 into the heat transfer coils 30, thereby warming the system. The temperature of the heat transfer coils 30 increases and the frost build-up melts. In addition, a heating element can also be added to the heat transfer coils 30 to increase the defrosting process. When the frost build-up is no longer blocking the light source 60 from reaching the photo-electric cell 68 inside the light receiver 65, the photo-electric cell 68 can re-energize. An adjustable timer 70 can also be used to control the time that the second medium 36 is prevented from entering the system. When the predetermined defrost time expires, the timer 70 energizes the relay 69 which energizes the solenoid valve 73. The valve 74 opens and the second medium 36 flows through the heat transfer coils 30.

Alternatively, the defrost mechanism can be controlled by a temperature measuring device. When the minimum temperature in the system is reached, the temperature control mechanism de-energizes the solenoid valve 73 and the valve 74 closes, preventing the flow of the second medium 36 from entering the heat transfer coil 30. When the temperature reaches a predetermined high temperature, the control energizes the solenoid valve 73, opening the valve 74 and the second medium 36 flows into the heat transfer coils 30.

The present invention has been described with respect to one embodiment. Alternative embodiments can also be made within the scope of the invention.

For example, FIG. 11 shows a cut away top view of the tubular heat exchange system 20 in accordance with another embodiment of the invention. This embodiment contains an additional fan system 90 located at the center of the tubular heat exchange system 20. This additional fan system 90 draws additional amounts of the first medium 35 into the heat exchange system 20. If the heat exchange system 20 is relatively long, additional fan systems 90 can also be positioned along the heat exchange system 20.

Figure 13:
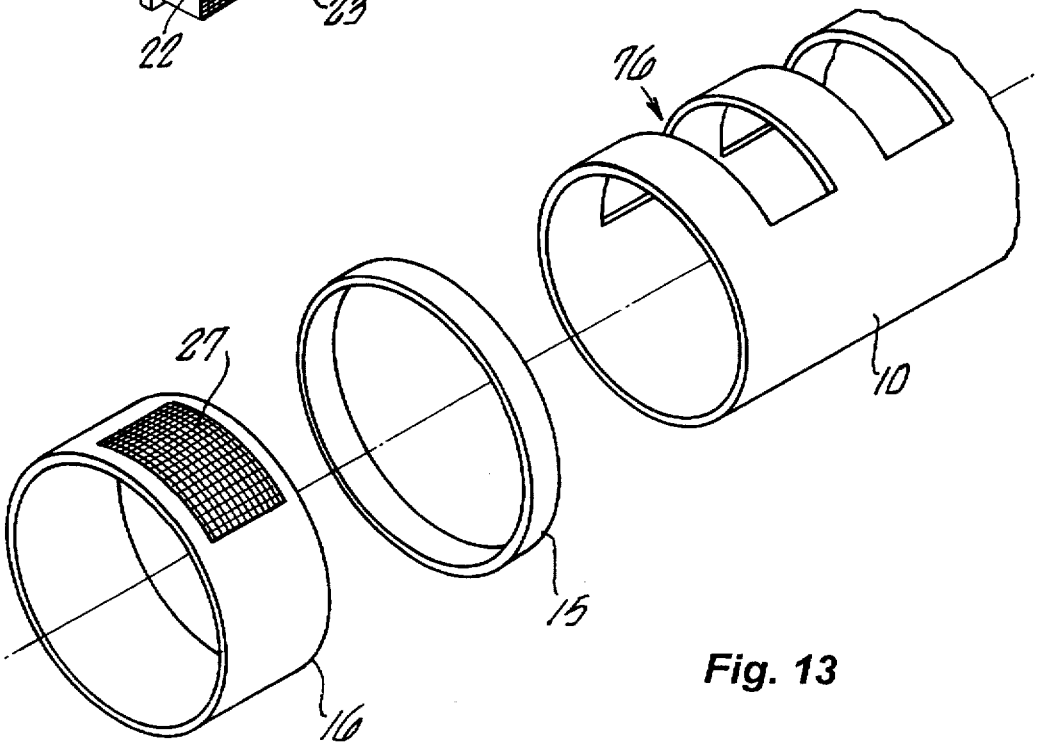
FIG. 13 is an exploded perspective view of an alternative embodiment of the present invention, where the rings are positioned within the inner tubular casing.

FIG. 13 shows an alternative embodiment of the present invention where the slide rings 16 can be positioned within the inner tubular casing 10. Slots 76 can be cut into the inner tubular casing 10. The slide rings 16 can be rotated within the inner tubular casing 10 securred between grooved outer keeper rings 15 also positioned within the inner tubular casing 10.

As another example, multiple tubular structures can be secured together to form any shape. In one embodiment, four tubular structures can be connected using 90 degree turns to form a square shaped system.

Therefore, the scope of the invention should be determined by the following claims and their legal equivalents, rather than by the examples given.

I claim:

1. A multi-purpose heat exchange system comprising: a substantially cylindrical tubular structure; a plurality of coils within said tubular structure; means to draw a first medium into the heat exchange system; means to release the first medium from the heat exchange system; and means to transport a second medium through said coils; said substantially cylindrical tubular structure including a first tube with solid portions and a cutaway portion; a second tube surrounding said first tube along the substantial entirety of the length of said first tube, said second tube having a plurality of cut slots positioned along the length of said second tube, said second tube being able to rotate around said first tube, and said release means being a series of openings where the cutaway portion of the first tube is aligned with the slots in said second tube.

2. The multipurpose heat exchange system of claim 1 where said coils are braided.

3. The multipurpose heat exchange system of claim 1 where said drawing means is a pump.

4. The multi-purpose heat exchange system of claim 3 where said drawing means includes pumps positioned at each end of the heat exchange system.

5. The multi-purpose heat exchange system of claim 3 where said drawing means includes pumps positioned at various predetermined locations along the length of the heat exchange system.

6. The multipurpose heat exchange system of claim 1 further comprising screens covering said slots.

7. The multipurpose heat exchange system of claim 1 further comprising a means for controlling frost in the system.

8. The multipurpose heat exchange system of claim 1 further comprising a drainage system.

9. The multipurpose heat exchange system of claim 8, said drainage system comprising:

a plurality of holes positioned at the bottom of said first tube;

a drain line secured below said tubular structure;

plugs positioned at both ends of said drain line.

10. A multi-purpose heat exchange system, comprising a substantially cylindrical tubular structure; a plurality of coils within said tubular structure; means to draw a first medium into the heat exchange system; means to release the first medium from the heat exchange system; and means to transport a second medium through said coils; said substantially cylindrical tubular structure including a tube with solid portions and cut-away portion; a plurality of first rings encircling said tube along the substantial entirety of the length of said tube; a plurality of second rings encircling said tube and having means to rotate around said tube, said second rings positioned between said first rings and having gap portions, said release means having a plurality of openings created where the gap portions in said second rings are aligned with the cut-away portion of said tube.

11. The multipurpose heat exchange system of claim 10 further comprising screens covering said slots.

12. The multipurpose heat exchange system of claim 10 further comprising a means for controlling frost in the system.

13. The multipurpose heat exchange system of claim 10 further comprising a drainage system.

14. The multipurpose heat exchange system of claim 13, said drainage system comprising:

a plurality of holes positioned at the bottom of said tubular structure;

a drain line secured below said tubular structure;

plugs positioned at both ends of said drain line;

a drain line secured to one of the plugs.

15. The multipurpose heat exchange system of claim 10 where said means for said second rings to rotate around said tube are grooves on the side edges of said first rings, said second rings being aligned in said grooves of said first rings.

16. The multipurpose heat exchange system of claim 10 where, a plurality of tees, elbow turns or pumps can be secured to the ends of the system by the user.

17. The multipurpose heat exchange system of claim 10 further comprising means for controlling the flow of the first medium through the system.

18. The multipurpose heat exchange system of claim 10 where individual systems can be connected together at the ends of the system to form a larger integrated system.

19. A multipurpose heat exchange system, comprising a substantially cylindrical tubular structure; a plurality of coils within said tubular structure; means to draw a first medium into the heat exchange system; means to release the first medium from the heat exchange system; and means to transport a second medium through said coils; said substantially cylindrical tubular structure including a tube with solid portions and cut-away portion; and a plurality of rings encircling said tube along the substantial entirety of the length of said tube, said rings having a gap portion and means to rotate said rings around said tube, said release means being a plurality of openings created where the gap portions in said rings are aligned with the cut-away portion of said tube.

* * * * *